US008307882B2

(12) United States Patent
Creasey

(10) Patent No.: US 8,307,882 B2
(45) Date of Patent: Nov. 13, 2012

(54) CASTING METHOD

(75) Inventor: Paul Andrew Creasey, Derby (GB)

(73) Assignee: Rolls-Royce PLC (GB)

( * ) Notice: Subject to any disclaimer, the term of this patent is extended or adjusted under 35 U.S.C. 154(b) by 28 days.

(21) Appl. No.: 12/698,281

(22) Filed: Feb. 2, 2010

(65) Prior Publication Data

US 2010/0193150 A1 Aug. 5, 2010

(30) Foreign Application Priority Data

Feb. 4, 2009 (GB) ..... 0901663.5

(51) Int. Cl.
*B22D 25/00* (2006.01)
*B22D 30/00* (2006.01)

(52) U.S. Cl. ..... 164/122.2; 164/23; 164/122.1; 164/127

(58) Field of Classification Search ..... 164/122.2, 164/127, 23, 122, 122.1
See application file for complete search history.

(56) References Cited

U.S. PATENT DOCUMENTS

| | | | | |
|---|---|---|---|---|
| 212,087 | A | 2/1879 | Baker et al. | |
| 4,469,161 | A | 9/1984 | Higginbotham et al. | |
| 4,550,764 | A | 11/1985 | Horton et al. | |
| 4,721,567 | A | 1/1988 | Uram | |
| 4,862,947 | A * | 9/1989 | Horton et al. | 164/122.2 |
| 5,234,047 | A | 8/1993 | Rose | |
| 5,269,365 | A | 12/1993 | Lallement et al. | |
| 5,275,227 | A * | 1/1994 | Staub | 164/122.1 |
| 5,868,194 | A * | 2/1999 | Horwood | 164/456 |
| 7,152,659 | B2 * | 12/2006 | Boswell | 164/361 |
| 2005/0211408 | A1 | 9/2005 | Bullied et al. | |
| 2005/0274478 | A1 | 12/2005 | Verner et al. | |

FOREIGN PATENT DOCUMENTS

| | | |
|---|---|---|
| EP | 1452251 | 9/2004 |
| EP | 1652603 | 5/2006 |
| FR | 2874340 | 2/2006 |
| GB | 2259660 A | 3/1993 |

OTHER PUBLICATIONS

Extended European Search Report dated May 12, 2010 for EP Application No. 10250048.5.

* cited by examiner

*Primary Examiner* — Devang R Patel
(74) *Attorney, Agent, or Firm* — McCormick, Paulding & Huber LLP

(57) ABSTRACT

In the casting of a single crystal component, such as a turbine blade, by the lost wax casting technique, one or more ceramic pieces are positioned on a wax pattern at locations corresponding to parts of the cast component where relatively quick solidification of molten metal may occur during casting. A coating is subsequently formed around the wax pattern to define a mould, whereupon the wax is removed to leave the one or more ceramic pieces within the formed mould.

2 Claims, 1 Drawing Sheet

CASTING METHOD

CROSS REFERENCE TO RELATED APPLICATION

This application is entitled to the benefit of British Patent Application No. GB 0901663.5, filed on Feb. 4, 2009.

FIELD OF THE INVENTION

This invention concerns a method of single crystal casting of a component, and particularly but not exclusively a turbine blade for a jet engine, a method of forming a mould for use in single crystal casting, and a mould for use in single crystal casting.

BACKGROUND OF THE INVENTION

Component casting is used in order to produce a wide range of components and members. Essentially, the component is cast in a mould from a molten liquid and then allowed to cool in order to leave a solidified component. Some components such as turbine blades for jet engines require structural abilities such as high temperature creep resistance. This is achieved with turbine blades through forming a single crystal. At high temperatures, typically above half the absolute melting temperatures of the metal, the grain boundaries become weaker than the grain bodies such that the absence of such grain boundaries in a single crystal provides resistance to creep.

Techniques for producing single crystal components are well known. Essentially the component is cast in a mould and then gradually withdrawn from a furnace in an appropriate manner such that propagation of a single crystal is achieved. Typically, a so called "pig-tail" selector is used in order to initiate a single grain or crystal growth. The most important consideration with respect to continued propagation of a single crystal within the component is to ensure so called directional solidification. This is achieved by gradual withdrawal, usually downwardly of the component from the furnace such that the temperature gradient is effectively controlled.

Generally, the interface temperature between the solid and liquid must be slightly lower than the melting point of the solid and the liquid temperature must increase beyond the interface. To achieve this temperature gradient, the latent heat of solidification must be conducted through the solidifying solid crystal. In any event, ideally the temperature interface should be flat and gradually progress through the component in order to ensure a uniform single crystal is provided with few, if any, defects at the interface. Particular problems can be experienced for instance at relatively thin and overhanging parts of the component, where the material may tend to solidify too quickly, and tend to grow its own grains.

It should also be understood that the solidus/liquidus mix or mushy zone between the solid component and the liquid material should be rendered as stagnant as possible. Unfortunately, most components by their nature are shaped and so provide differing radiation heat effects due to the varying thickness of the component at particular points. These changes render it difficult to fully control the temperature gradient and therefore an unacceptable proportion of components are rejected due to defects formed during casting.

SUMMARY OF THE INVENTION

A preferred method of component casting is that known as the lost wax process. This is a traditional technique in which a component is initially formed as a wax structure and then a ceramic coat is placed upon that wax structure and allowed to harden. The wax is then removed, typically by heating, in order to leave the ceramic as a mould for the component. As indicated above, the component is cast from a molten liquid and then allowed to cool and solidify.

According to the present invention there is provided a method of single crystal casting of a component, the method including locating within a mould one or more pieces of ceramic material at a location or locations corresponding to a part or parts of the component where relatively quick solidification of molten metal may occur during casting.

The invention further provides a method of fowling a mould for use in single crystal casting of a component, the method including forming a wax structure with one or more pieces of ceramic material at a location or locations corresponding to a part or parts of the component where relatively quick solidification of a molten metal may occur during casting, forming a coating around the wax structure, and removing the wax to provide a mould formed by the coating, with the one or more pieces of ceramic material located within the mould.

The one or more pieces of ceramic material may be adhered to the wax structure prior to forming of the coating.

In an alternative arrangement the one or more pieces of ceramic material may be located in a die and the wax in liquid form is poured into the die so as to solidify with the one or more pieces of ceramic material adhered thereto.

The one or more pieces of ceramic material may be located in the mould so as to extend during casting substantially below the part or parts of the component where relatively quick solidification of a molten metal may occur during casting.

The invention still further provides a method of forming a turbine blade for a jet engine, the method being according to any of the preceding five paragraphs.

The invention yet further provides a mould for use in single crystal casting of a component, the mould including therewithin one or more pieces of ceramic material at a location or locations corresponding to a part or parts of the component where relatively quick solidification of molten metal may occur during casting.

DETAILED DESCRIPTION OF THE PREFERRED EMBODIMENTS

Figure 1:
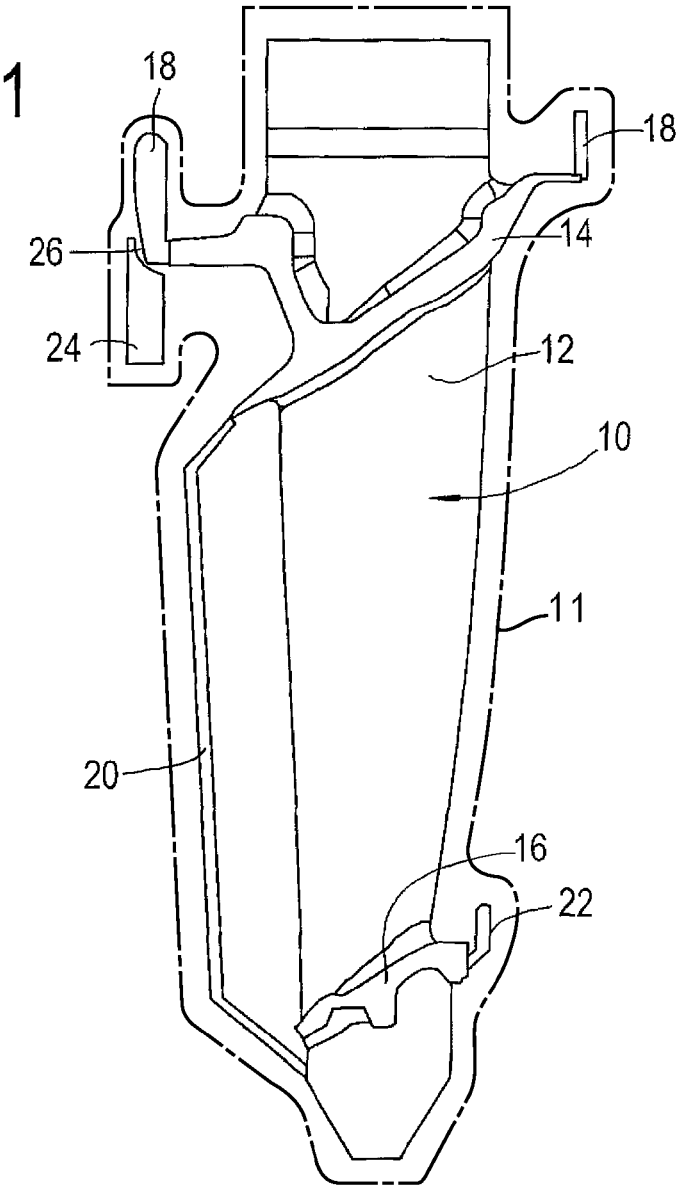
FIG. 1 is a diagrammatic side view of part of a wax structure usable in a method according to the invention.

FIG. 1 shows part of a wax structure 10 usable in casting a turbine blade for a jet engine. This would typically be an integral part of a larger wax structure usable to form a mould 11 (shown in phantom line). The features which will form the blade can be seen in the structure 10, being namely an aerofoil 12 extending between upper and lower platforms 14, 16. Extending upwardly from the part forming the upper platform 14 are two tabs 18 which in a mould form feeders to supply molten metal to difficult to cast areas.

A link 20 of wax extends between the upper platform 14 and lower platform 16 providing in a mould a continuation bar to ensure consistent grain growth to the lower platform part 16. A further tab 22 is provided on the opposite side of the lower platform part 16 to the link 20, to provide a feed of molten metal to the lower platform part 16.

Figure 2:
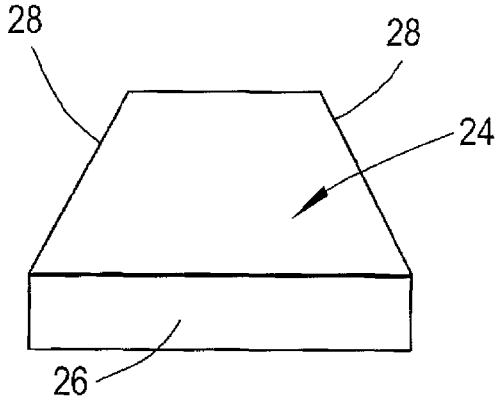
FIG. 2 is a diagrammatic perspective view of a component attached to the wax structure of FIG. 1.

Attached to the left hand tab 18 as shown, and extending downwardly therefrom, is a ceramic piece 24 (see FIG. 2). The piece 24 has a substantially constant thickness and has a curved upper end 26 and side walls 28 which converge downwardly. The upper end 26 is curved to substantially correspond to the curvature of the tab 18, and the ceramic piece 24 may be glued thereto. Alternatively the ceramic piece may be attached to the wax structure 10 by a sealing wax.

In use, the wax structure 10 is formed by pouring liquid wax in an appropriately shaped die. Following solidification of the structure 10 the ceramic piece 24 is adhered thereto. A mould is then formed by providing a ceramic coating of a number of layers around the wax structure 10 with the ceramic piece 24 adhered thereto. The wax structure 10 is then burnt off leaving a moulding cavity within the mould formed by the coating on the wax structure 10, with the ceramic piece 24 located within the moulding cavity, adhered to the walls of the mould.

A single crystal casting of a turbine blade can then take place, with the mould located in a furnace and molten metal being fed into the mould runner system. The mould is then gradually withdrawn downwardly from the furnace, causing the metal to solidify as a single crystal. As and shortly after the part of the component immediately above where the ceramic piece 24 is located, exits from the furnace, cooling of the component at that point is delayed by the heat retained by the ceramic piece. In this instance this part of the component corresponds to the lower seal fin of the turbine blade.

Once a component has been formed it can be removed from the mould for instance by vibration, and the piece of ceramic can readily be removed from the component.

There is thus described a method of single crystal casting, and a method of forming a mould for use in single crystal casting which permits the rate of solidification of the component at specific areas to be controlled as required. Whilst providing such control, the complexity and cost of the casting process is not significantly affected, in contrast to alternative proposed control methods such as providing a greater area of wax and hence cast material which would require subsequent removal, or the use of further continuators to ensure consistent grain growth. The ceramic material is inert relative to the casting process, and will not adhere to the cast material, and thus can be readily removed therefrom.

One or more pieces of ceramic can be located where required, and in the present instance the ceramic used is a by product of the ceramic core already used to form the turbine blade. Obviously the size, location and number of the ceramic pieces used can be provided as required by a particular component. For instance it may be appropriate to provide a ceramic piece for the shroud leading edge. It is noted that the ceramic piece extends in use immediately below the respective part of the component to provide continued heat thereto, and thus reduce the rate of solidification which would otherwise occur.

Various other modifications may be made without departing from the scope of the invention. For instance the ceramic piece or pieces can be adhered to the wax structure by a different method. It may for instance be possible to include the wax pieces in a die used to form the wax structure, such that the ceramic pieces are incorporated into the wax structure during formation thereof.

What is claimed is:

1. A method of single crystal casting of a component, the method comprising:

forming a wax pattern of the component with one or more pieces of ceramic material adjacent to the wax pattern in direct thermal contact with a location or locations corresponding to a part or parts of the component where relatively quick solidification of a molten liquid may occur during casting relative to the remainder of the component, wherein the one or more pieces of ceramic material are located in a die and wax in liquid form is poured into the die so as to solidify with the one or more pieces of ceramic material adhered to the wax pattern;

forming a mould about the wax pattern and the one or more pieces of ceramic material;

providing a molten liquid within a volume bounded by the one or more ceramic pieces and the mould located in a furnace; and gradually withdrawing the mould downwardly from the furnace, wherein the one or more pieces of ceramic material retain heat of the furnace, and direct thermal contact of the one or more pieces of ceramic material with a corresponding part or parts of the component delays cooling of the corresponding part or parts, such that propagation of a single crystal is achieved.

2. A method of forming a mould during single crystal casting of a component according to claim 1, the method comprising the steps of:

forming a wax structure with one or more pieces of ceramic material adjacent to a location or locations corresponding to a part or parts of the component where relatively quick solidification of a molten metal may occur during casting;

forming a coating of multiple layers around the wax structure; and removing the wax to provide a mould formed by the coating with wall thickness enhanced by the one or more ceramic pieces, at a location or locations within the mould corresponding to a part or parts of the component where, absent the one or more pieces of ceramic material, relatively quick solidification of a molten metal would occur during casting relative to the remainder of the component.

* * * * *